US007854154B2

(12) United States Patent
Pawelski

(10) Patent No.: US 7,854,154 B2
(45) Date of Patent: Dec. 21, 2010

(54) PROCESS AND COMPUTER PROGRAM FOR CONTROLLING A ROLLING PROCESS

(75) Inventor: Hartmut Pawelski, Ratingen (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 734 days.

(21) Appl. No.: 11/793,125

(22) PCT Filed: Nov. 30, 2006

(86) PCT No.: PCT/EP2006/011486

§ 371 (c)(1),
(2), (4) Date: Jun. 12, 2007

(87) PCT Pub. No.: WO2007/068359

PCT Pub. Date: Jun. 21, 2007

(65) Prior Publication Data

US 2008/0127696 A1 Jun. 5, 2008

(30) Foreign Application Priority Data

Dec. 14, 2005 (DE) ..... 10 2005 059 653

(51) Int. Cl.

| | |
|---|---|
| ***B21B 37/48*** | (2006.01) |
| ***B21B 37/24*** | (2006.01) |
| ***B21B 37/58*** | (2006.01) |
| ***B21B 23/00*** | (2006.01) |
| ***B21B 39/08*** | (2006.01) |

(52) U.S. Cl. ..... 72/8.6; 72/7.1; 72/10.4; 72/365.2; 72/205

(58) Field of Classification Search ..... 72/6.1–14.7, 72/199–252.5, 365.2; 700/148, 152
See application file for complete search history.

(56) References Cited

U.S. PATENT DOCUMENTS

| | | | | |
|---|---|---|---|---|
| 4,576,029 | A * | 3/1986 | Miyake et al. | 72/205 |
| 4,745,556 | A * | 5/1988 | Turley | 72/12.1 |
| 5,365,761 | A * | 11/1994 | Knauschner et al. | 72/11.6 |
| 5,520,037 | A * | 5/1996 | Sorgel | 72/8.4 |

FOREIGN PATENT DOCUMENTS

| | | |
|---|---|---|
| JP | 55 61309 | 5/1980 |
| JP | 55068101 | 5/1980 |
| JP | 57115909 | 7/1982 |
| JP | 59166310 | 9/1984 |
| JP | 62 179803 | 8/1987 |

* cited by examiner

*Primary Examiner*—Dana Ross
*Assistant Examiner*—Mohammad Yusuf
(74) *Attorney, Agent, or Firm*—Andrew Wilford

(57) ABSTRACT

The invention relates to a method for controlling a rolling process, in which a metal strip is rolled flat by use of at least one roller. It is known from the prior art that the relative position of a neutral point represents a measure of the instantaneous stability of a rolling process. However, traditional methods for calculating the position of the neutral point do not accurately represent the actual properties of metal and therefore have only limited usefulness for predicting the stability of a rolling process. In order to allow better control of a rolling process for rolling a metal strip with regard to the actual behavior of the metal strip, the invention proposes a new method for calculating the relative position of the neutral point, in which in particular the flat yield stress $k_e$ and the hydrostatic pressure $p_N^H$ at the neutral point are incorporated.

7 Claims, 3 Drawing Sheets

PROCESS AND COMPUTER PROGRAM FOR CONTROLLING A ROLLING PROCESS

CROSS REFERENCE TO RELATED APPLICATIONS

This application is the US national phase of PCT application PCT/EP2006/011486, filed 30 Nov. 2006, published 21 Jun. 2007 as WO2007/068359, and claiming the priority of German patent application 102005059653.3 itself filed 14 Dec. 2005, whose entire disclosures are herewith incorporated by reference.

FIELD OF THE INVENTION

The invention relates to a method and a computer program for controlling a rolling process in which a metal strip is rolled flat by at least two rollers. In principle the invention relates to all types of rolling processes, such as cold rolling, hot rolling, or finish rolling; however, the preferred application is for cold-rolling processes.

Such a method is known in principle from the prior art, for example from Japanese patent application JP 55061309A. The cited document describes how the stability of the rolling process is dependent on the particular position of a so-called neutral point. The neutral point refers to the position on the circumference of a working roller at which the circumferential speed of the working roller equals the speed of the rolled material. To ensure the stability of the rolling process, the cited Japanese patent application teaches the regulation of the strip tension such that the position of the neutral point is always inside a contact arc between the roller and the rolled material.

However, calculation of the position of the neutral point is trivial only for an ideal plastic material, and can be determined for such materials only from measurable parameters for the rolling process. Use of the traditionally calculated (relative) position of the neutral point as a criterion for the stability of a rolling process, therefore, is possible only in limited cases for a nonideal plastic material, i.e. in particular for an elastic-plastic material such as real metals. The reason is that traditionally, the (relative) position of the neutral point for rolling processes of real metals by use of measurable rolling parameters cannot be determined without some inaccuracy.

OBJECT OF THE INVENTION

Proceeding from this prior art, the object of the present invention is to improve a known method and computer program for controlling a rolling process according to the relative position of the neutral point between a roller and a metal strip to be rolled, with respect to the actual behavior of the metal strip during the rolling process.

SUMMARY OF THE OBJECT

This object is achieved by a method is characterized in that the value of the flat yield stress $k_e$ of the metal strip and the value of the hydrostatic pressure $p_N^H$ at the neutral point are estimated as not directly measurable process parameters by use of a mathematical model for the individual rolling process on the basis of a first and a second group of measurable process parameters, and that the relative position of the neutral point is calculated based on the estimated values for the flat yield stress $k_e$ and the hydrostatic pressure $p_N^H$ on the basis of the first group of measurable process parameters and on the basis of the flat modulus of elasticity E* of the metal strip and of the compressibility K of the metal strip.

By considering the flat yield stress of the metal strip and the value of the hydrostatic pressure at the neutral point, the relative position of the neutral point may be calculated much more precisely, i.e. more accurately and closer to reality, than has been the case heretofore. This is true in particular because, due to the consideration of the hydrostatic pressure, the volumetric compression of the metal strip during the rolling process enters into the calculation of the position of the neutral point. In addition, the deflection of the strip after passing through the narrowest point of the roller gap is taken into account. This consideration is particularly important for cases in which the values of the advance parameter are approximately zero. The information about the actual position of the neutral point, which is closer to reality by virtue of the invention, allows a control device or an operator observing or controlling the rolling process to intervene more quickly and efficiently in the rolling process to ensure its stability.

Because the parameters of yield stress and hydrostatic pressure at the neutral point are necessary for the more precise calculation of the relative position of the neutral point, but are not easily measurable as measurement parameters during the rolling process, according to the invention these parameters are simulated by a mathematical model that may be adapted to each individual rolling process, and preferably are calculated in real time to provide the actual position of the neutral point for the calculation in a timely manner. However, as input variables for the mathematical model it is advantageous to use only process parameters which can be measured during the rolling process.

According to the invention, the relative position of the neutral point is advantageously calculated according to the following formula:

$$\xi = \sqrt{\frac{(f_{slip}+1)\left(1-\frac{\sigma_A}{3K}-\frac{p_N+q_N}{2K}+\frac{k_e-\sigma_A}{E^*}\right)-1}{h_E/h_A\left(1+\frac{k_e-\sigma_A}{E^*}\right)-1}}$$

where $f_{slip}$: represents the advance;

$\sigma_A$: represents the strip outlet tension;

K: represents the compressibility of the metal strip;

$p_N$: represents the pressure in the roller gap at the neutral point, perpendicular (normal) to the metal strip;

$q_N$: represents the pressure in the roller gap at the neutral point, in the longitudinal direction of the metal strip;

$k_e$: represents the flat yield stress;

E*: represents the flat modulus of elasticity of the metal strip;

$h_E$: represents the strip thickness at the inlet; and $h_A$: represents the strip thickness at the outlet.

The rolling process is classified as stably operating when the calculated value ξ for the relative position of the neutral point is between a lower threshold value of approximately 0.12 and an upper threshold value of approximately 0.4.

If the value ξ is less than the lower threshold value, this indicates that the rolling process is unstable; the rolling process must then be restabilized by use of suitable measures such as increasing the strip tension at the outlet, decreasing the strip tension at the inlet, or increasing the friction in the roller gap.

In another case, when the value ξ for the relative position of the neutral point is greater than the upper threshold value of approximately 0.4, this indicates that the friction in the roller gap is too high, and therefore the wear on the rollers is likewise too high, which must then be counteracted by suitable measures.

For documentation purposes it is advantageous when the relative position of the neutral point calculated according to the invention is preferably stored over its elapsed time period. Irrespective of this measure, for rapid initiation of actions to stabilize the rolling process or to eliminate excessive frictional forces in the roller gap it is advantageous when the relative position of the neutral point calculated according to the invention is displayed for an operator on a display device, preferably in real time.

The above-referenced object of the invention is further achieved by a computer program for a control device for controlling a rolling process according to the method described above.

BRIEF DESCRIPTION OF THE DRAWING

Three figures accompany the description, namely

FIG. 1 shows a pair of rollers for providing a roller gap, with a metal strip passed through;

SPECIFIC DESCRIPTION

The invention is described in detail below, with reference to the described figures, in the form of exemplary embodiments.

Figure 1:
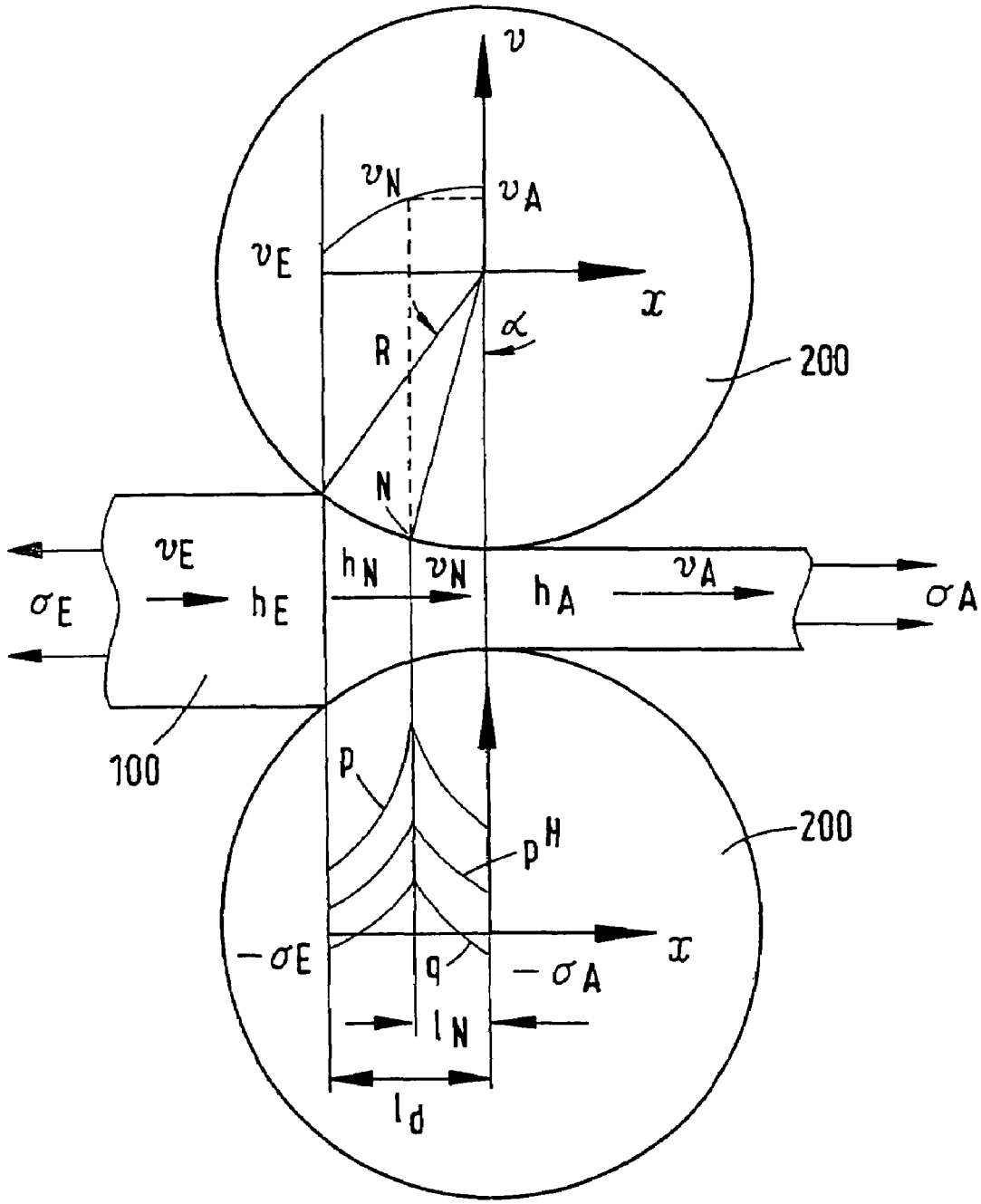

FIG. 1 shows a roll stand comprising a pair of rollers, in which the rollers 200 are vertically superposed and a roller gap is provided between the two rollers 200. For carrying out a rolling process a metal strip 100 is passed through the roller gap and flat-rolled. Both the upper and the lower (working) rollers 200 contact the metal strip 100 in a contact arc, which for the upper roller 200 is represented by the arc length for the angle α.

Within the scope of the present invention, the relative position of the neutral point is used as a measure or criterion of the stability of an individual rolling process. In FIG. 1 the neutral point is designated by reference numeral N by way of example. The neutral point represents the position on the circumference of a roller at which the circumferential speed of the roller equals the speed of the rolled material, here the rolled metal strip.

The direction of material flow is indicated by the horizontal arrows in FIG. 1, where the arrows run from left to right. The parameter R denotes the radius of the roller 200, the parameter $v_E$ denotes the speed of the metal strip 100 at the inlet of the roller gap, the parameter $v_A$ denotes the speed of the metal strip at the outlet of the roller gap, and the parameter $v_N$ denotes the speed of the metal strip 100 at the neutral point N. All other parameters illustrated in FIG. 1 are explained in greater detail below.

An estimation of the stability of a rolling process and a decision to initiate measures to stabilize the rolling process may be made more accurately the more precisely, i.e. the more closely to reality, the instantaneous position of the neutral point is known.

Figure 2:
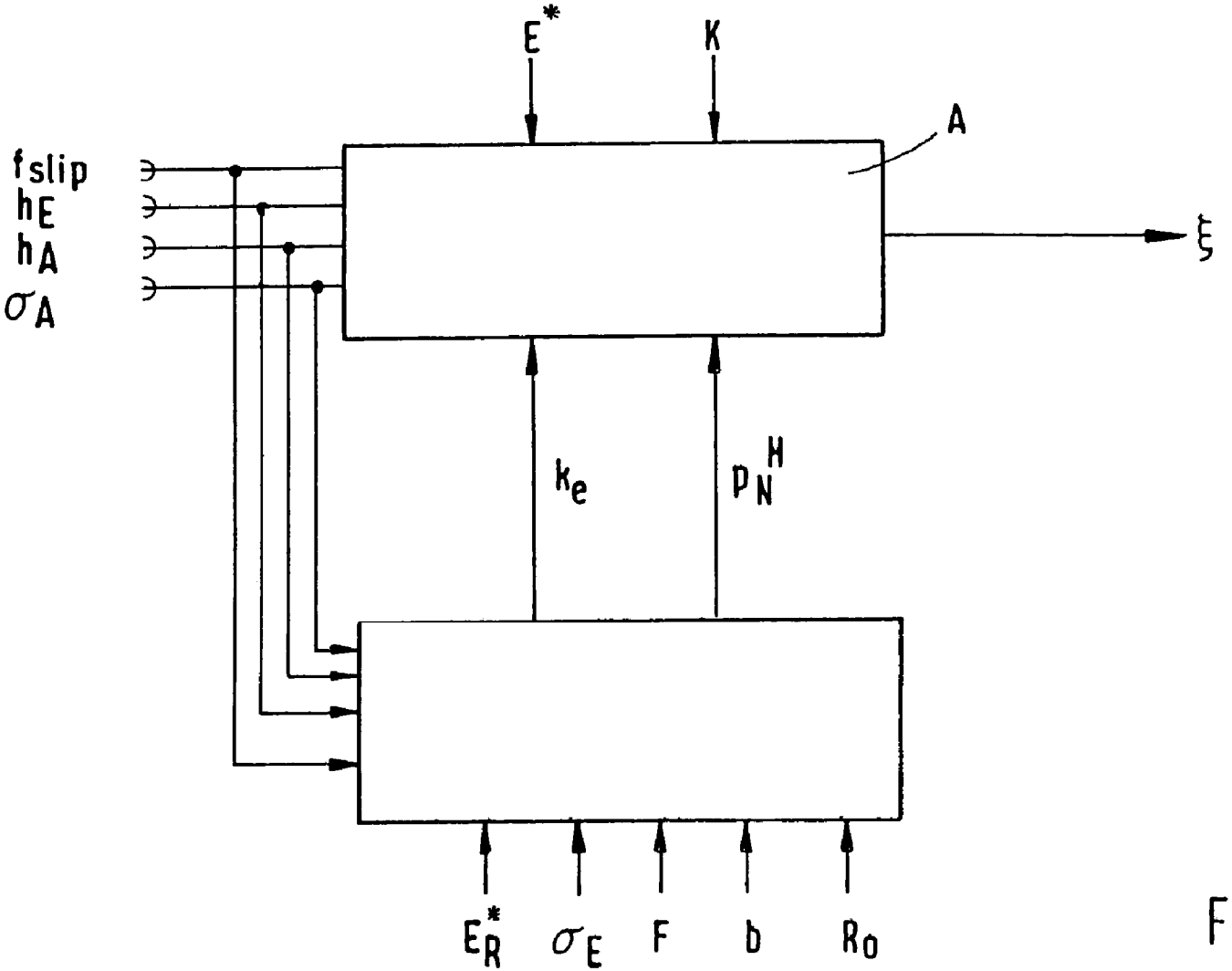
FIG. 2 shows a block diagram for illustrating the method according to the invention.

With reference to FIG. 2 the method according to the invention is explained, by means of which a calculation of the relative position of the neutral point that is very precise and close to reality is possible at any time during a rolling process.

According to the invention, the relative position of the neutral point N is calculated according to the following formula:

$$\xi = \sqrt{\frac{(f_{slip}+1)\left(1-\frac{\sigma_A}{3K}-\frac{p_N+q_N}{2K}+\frac{k_e-\sigma_A}{E^*}\right)-1}{h_E \Big/ h_A\left(1+\frac{k_e-\sigma_A}{E^*}\right)-1}}$$

where $f_{slip}$: represents the advance; $\sigma_A$: represents the strip outlet tension;

K: represents the compressibility of the metal strip (100);

$p_N$: represents the pressure in the roller gap at the neutral point, perpendicular (normal) to the metal strip;

$q_N$: represents the pressure in the roller gap at the neutral point, in the longitudinal direction of the metal strip;

$k_e$: represents the flat yield stress;

E*: represents the flat modulus of elasticity of the metal strip (100);

$h_E$: represents the strip thickness at the inlet; and $h_A$: represents the strip thickness at the outlet of the roller gap.

In FIG. 2 the relative position ξ of the neutral point is calculated in block A. The above-referenced parameters that enter into the calculation of ξ are likewise shown in FIG. 2. Of these parameters, the advance $f_{slip}$, the height $h_E$ of the metal strip at the inlet of the roller gap, the height $h_A$ of the metal strip at the outlet of the roller gap, and the strip tension $\sigma_A$ at the outlet of the roller gap form a first group of process parameters that are directly measurable at any time during a rolling process. The flat modulus of elasticity E* of the metal strip 100 and the compressibility K of the metal strip are known in principle. On the other hand, the values for the flat yield stress $k_e$ and the pressure $p_N^H$ in the roller gap at the neutral point perpendicular, i.e. normal, to the metal strip, which are also necessary for calculating the relative position ξ of the neutral point according to the invention, are not known in principle and also are not measurable during a rolling process. Because the two latter-referenced parameters are not directly measurable, according to the invention they are estimated on the basis of the first group of parameters and on the basis of a second group of parameters, using a mathematical model for the individual rolling process. The second group of process parameters includes the strip inlet tension $\sigma_E$ at the inlet of the roller gap, the roller force F, the width of the metal strip b, the radius $R_0$ of the (working) roller 200, and the flat modulus of elasticity $E^*_R$ of the roller. The process parameters for the second group are also individually measurable during a rolling process, so that the sought values for the flat yield stress $k_e$ and for the pressure $p_N^H$ in the roller gap at the neutral point perpendicular to the metal strip may thus be calculated solely from measurable parameters. The calculation is preferably performed in real time so that the values for ξ are available as instantaneously as possible to allow a targeted, efficient intervention in the rolling process, if necessary.

Figure 3:
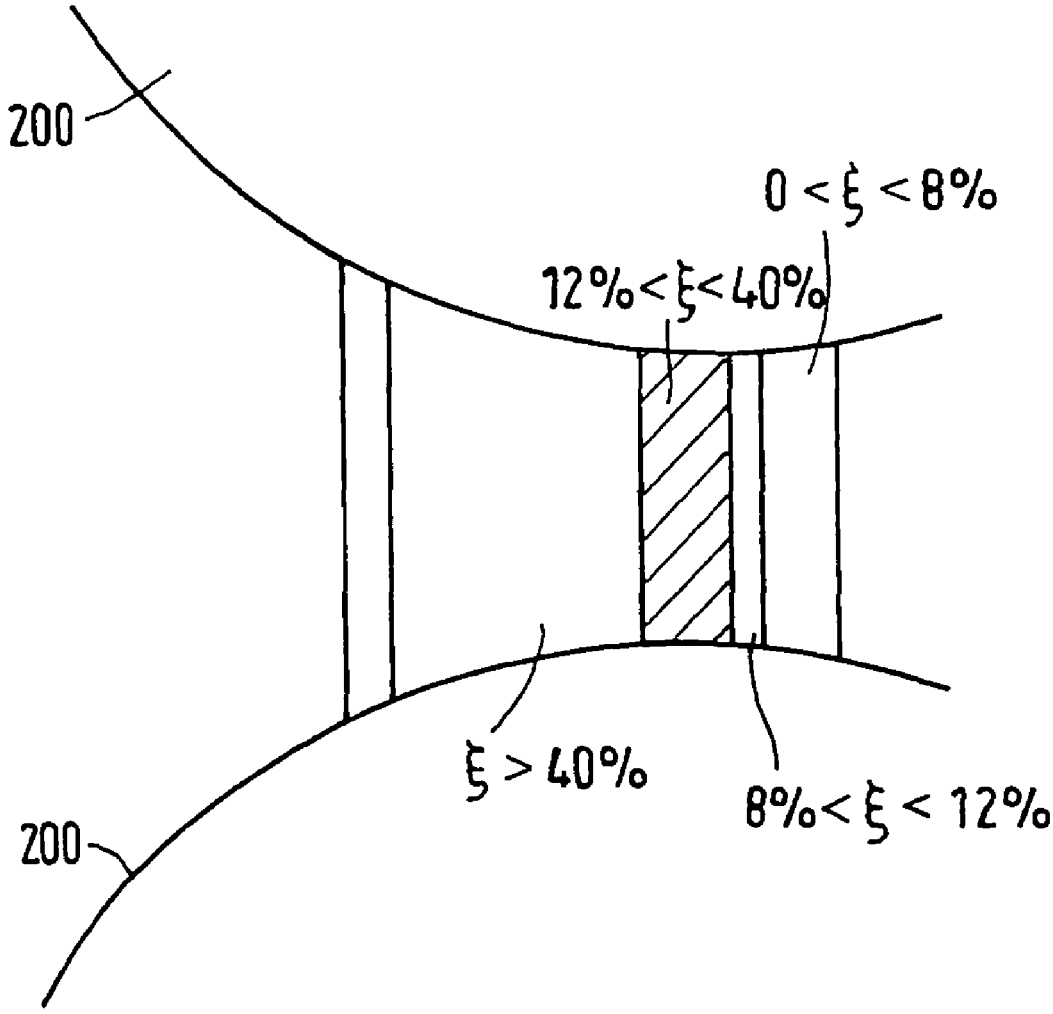
FIG. 3 shows various possible position regions for the relative position of the neutral point in a roller gap.

FIG. 3 illustrates various regions for possible relative positions ξ of the neutral point in the roller gap between the two rollers 200. A cross-hatched region is shown which is bordered by a lower threshold value of approximately 0.12 and an upper threshold value of 0.4 for the value of ξ. When ξ lies in the cross-hatched region, i.e. ξ has a value between the upper and the lower threshold values, the rolling process is classified as stable and requires no measures for intervening in the rolling process to provide stability.

The situation is different when the value calculated according to the invention is between 0.08 and 0.12; in that case the rolling process is classified as critical, i.e. less stable with respect to fluctuations of the process parameters. The rolling process is even more critical, because it is more unstable, for smaller values of $\xi$, in particular for values between 0 and 0.08. In both cases of instability, the rolling process must be stabilized by suitable measures, the extent of which (possibly also in combination) depends on the degree of instability. The rolling process may be stabilized by increasing the strip tension $\sigma_A$ at the outlet of the roller gap, reducing the strip tension $\sigma_E$ at the inlet of the roller gap, and/or increasing the friction in the roller gap. The latter may be achieved, for example, by increasing the roughness of the roller 200, reducing the amount of lubricant, and/or reducing the roller speed.

For values of $\xi$ greater than 0.4, the friction in the roller gap is excessive. This has the disadvantage that the forces that occur, and consequently the wear on the rollers, are too great. This may be remedied by suitable measures such as reducing the strip tension $\sigma_A$ at the outlet of the roller gap, increasing the strip tension $\sigma_E$ at the inlet of the roller gap, and/or reducing the friction between the roller 200 and the metal strip 100. The friction may be reduced by decreasing the roughness of the roller, increasing the amount of lubricant, and/or increasing the roller speed. The measures described in this paragraph may also be used individually or in combination, depending on the intensity required.

The measures discussed in the previous paragraph may be initiated either automatically or by an operator, according to the calculated value of the position $\xi$ of the neutral point. When the interventions are to be initiated by an operator, it is helpful for the particular instantaneous position of the neutral point to be illustrated for the operator in a display similar to that in FIG. 3. Based on the displayed instantaneous position $\xi$ of the neutral point, the operator can then immediately ascertain whether the rolling process is currently running in a stable, unstable, or overstable manner, and accordingly can institute suitable measures.

For documentation purposes it is advantageous when the value $\xi$ is stored in its elapsed time period.

The calculation of the value $\xi$ for the neutral position of the point according to the invention is advantageously carried out in a computer program for a control device for controlling a rolling process.

The invention claimed is:

1. A method of controlling a rolling process in which a metal strip is rolled flat by use of at least one roller, the method comprising the steps of:

detecting the position of a neutral point in a contact arc between the metal strip and the roller;

stabilizing the rolling process such that a position $\xi$ of the neutral point is between a lower threshold value of 0.12 and an upper threshold value of 0.40 by intervening in the rolling process by use of suitable measures;

calculating the value of the flat yield stress $k_e$ of the metal strip and the value of the hydrostatic pressure $p_N^H$ at the neutral point as not directly measurable process parameters based on the calculated values for the flat yield stress $k_e$ and the hydrostatic pressure $p_N^H$ on the basis of a first group of measurable process parameters and on the basis of the flat modulus of elasticity E* of the metal strip and of the compressibility K of the metal strip;

calculating the position $\xi$ of the neutral point according to the following formula:

$$\xi = \sqrt{\frac{(f_{slip}+1)\left(1-\frac{\sigma_A}{3K}-\frac{p_N+q_N}{2K}+\frac{k_e-\sigma_A}{E^*}\right)-1}{h_E\Big/h_A\left(1+\frac{k_e-\sigma_A}{E^*}\right)-1}}$$

where $f_{slip}$: represents the advance;

$\sigma_A$: represents the strip outlet tension;

K: represents the compressibility of the metal strip;

$p_N$: represents the pressure in the roller gap at the neutral point, perpendicular to the metal strip;

$q_N$: represents the pressure in the roller gap at the neutral point, in the longitudinal direction of the metal strip;

$k_e$: represents the flat yield stress;

E*: represents the flat modulus of elasticity of the metal strip;

$h_E$: represents the strip thickness at the inlet; and $h_A$: represents the strip thickness at the outlet.

2. The method according to claim 1 wherein the first group of measurable process parameters for calculating the flat yield stress $k_e$, the hydrostatic pressure $p_N^H$ at the neutral point, or the position of the neutral point comprises the parameters advance $f_{slip}$, the strip inlet thickness $h_E$, the strip inlet thickness $h_A$, and the strip outlet tension $\sigma_A$ of the metal strip.

3. The method according to claim 1 wherein the second group of measurable process parameters for calculating the flat yield stress $k_e$ or the hydrostatic pressure $p_N^H$ at the neutral point comprises the strip inlet tension $\sigma_E$, the roller force F, the strip width b, the radius $R_0$ of the roller, and the flat modulus of elasticity $E^*_R$ of the roller.

4. A method of controlling a rolling process in which a metal strip is rolled flat by use of at least one roller, the method comprising the steps of:

detecting the position of a neutral point in a contact arc between the metal strip and the roller;

stabilizing the rolling process according to a position $\xi$ of the neutral point by intervening in the rolling process by use of suitable measures by increasing the strip tension at the outlet, decreasing the strip tension at the inlet, or increasing the friction in the roller gap when the position $\xi$ of the neutral point is between zero and a lower threshold value of 0.12;

calculating the value of the flat yield stress $k_e$ of the metal strip and the value of the hydrostatic pressure $p_N^H$ at the neutral point as not directly measurable process parameters by use of a mathematical model for the individual rolling process on the basis of a first and a second group of measurable process parameters;

calculating the position of the neutral point based on the estimated values for the flat yield stress $k_e$ and the hydrostatic pressure $p_N^H$ on the basis of the first group of measurable process parameters and on the basis of the flat modulus of elasticity E* of the metal strip and of the compressibility K of the metal strip; and calculating the position of the neutral point according to the following formula:

$$\xi = \sqrt{\frac{(f_{slip}+1)\left(1-\frac{\sigma_A}{3K}-\frac{p_N+q_N}{2K}+\frac{k_e-\sigma_A}{E*}\right)-1}{h_E\Big/h_A\left(1+\frac{k_e-\sigma_A}{E*}\right)-1}}$$

where $f_{slip}$: represents the advance;

$\sigma_A$: represents the strip outlet tension;

K represents the compressibility of the metal strip;

$p_N$: represents the pressure in the roller gap at the neutral point, perpendicular to the metal strip;

$q_N$: represents the pressure in the roller gap at the neutral point, in the longitudinal direction of the metal strip;

$k_e$: represents the flat yield stress;

E*: represents the flat modulus of elasticity of the metal strip;

$h_E$: represents the strip thickness at the inlet; and $h_A$: represents the strip thickness at the outlet.

5. A method of controlling a rolling process in which a metal strip is rolled flat by use of at least one roller, the method comprising the steps of:

detecting the position of a neutral point in a contact arc between the metal strip and the roller;

stabilizing the rolling process according to a position of the neutral point by intervening in the rolling process by use of suitable measures;

calculating the value of the flat yield stress $k_e$ of the metal strip and the value of the hydrostatic pressure $p_N^H$ at the neutral point as not directly measurable process parameters by use of a mathematical model for the individual rolling process on the basis of a first and a second group of measurable process parameters;

calculating the position of the neutral point based on the estimated values for the flat yield stress $k_e$ and the hydrostatic pressure $p_N^H$ on the basis of the first group of measurable process parameters and on the basis of the flat modulus of elasticity E* of the metal strip and of the compressibility K of the metal strip;

decreasing the strip tension at the outlet, increasing the strip tension at the inlet, or reducing the friction when the position ξ of the neutral point is greater than an upper threshold value of 0.4; and calculating the position ξ of the neutral point according to the following formula:

$$\xi = \sqrt{\frac{(f_{slip}+1)\left(1-\frac{\sigma_A}{3K}-\frac{p_N+q_N}{2K}+\frac{k_e-\sigma_A}{E*}\right)-1}{h_E\Big/h_A\left(1+\frac{k_e-\sigma_A}{E*}\right)-1}}$$

where $f_{slip}$: represents the advance;

$\sigma_A$: represents the strip outlet tension;

K: represents the compressibility of the metal strip;

$p_N$: represents the pressure in the roller gap at the neutral point, perpendicular to the metal strip;

$q_N$: represents the pressure in the roller gap at the neutral point, in the longitudinal direction of the metal strip;

$k_e$: represents the flat yield stress;

E*: represents the flat modulus of elasticity of the metal strip;

$h_E$: represents the strip thickness at the inlet; and $h_A$: represents the strip thickness at the outlet.

6. The method according to claim 1 wherein the rolling process is stabilized either automatically or by intervention by an operator in the rolling process, according to the calculated position of the neutral point.

7. The method according to claim 1 wherein the calculated position of the neutral point is preferably stored over its elapsed time period, or is displayed for an operator on a display device.

* * * * *